United States Patent [19]

Mullins et al.

[11] 4,083,467

[45] Apr. 11, 1978

[54] INFANT TRAINING TUMBLER

[75] Inventors: Keith M. Mullins; Thomas Cannon; Thomas K. Leppert, all of Fort Collins; Thomas R. Burnell, Bellvue, all of Colo.

[73] Assignee: Teledyne Industries, Inc., Ft. Collins, Colo.

[21] Appl. No.: 792,600

[22] Filed: May 2, 1977

[51] Int. Cl.[2] ..... A47G 19/22

[52] U.S. Cl. ..... 220/90.4; 222/486; 222/548

[58] Field of Search ..... 220/20, 90.2, 90.4, 220/90.6, 253, 254, 22; 128/222; 222/23, 130, 486, 463, 548; D7/6, 10, 59

[56] References Cited

U.S. PATENT DOCUMENTS

| | | | |
|---|---|---|---|
| D. 165,778 | 1/1952 | Olsen | 220/90.6 |
| 1,714,368 | 5/1929 | Hobson | 220/253 |
| 2,875,925 | 3/1959 | Smith | 222/486 |
| 3,172,561 | 3/1965 | Schwartz | 220/90.2 |
| 3,261,494 | 7/1966 | Walker, Jr. | 220/20 |
| 3,261,516 | 7/1966 | Allen | 222/548 |
| 3,412,892 | 11/1968 | Waksman | 220/90.4 |
| 3,967,748 | 7/1976 | Albert | 220/90.4 |

FOREIGN PATENT DOCUMENTS

| | | | |
|---|---|---|---|
| 923,973 | 7/1947 | France | 220/253 |

*Primary Examiner*—George E. Lowrance
*Assistant Examiner*—Allan N. Shoap
*Attorney, Agent, or Firm*—Hugh H. Drake

[57] ABSTRACT

An infant training tumbler includes an upright tubular housing within which is an upright internal web that divides the housing into a pair of longitudinal compartments. Affixed upon the upper end of the housing is a cap that completes a closure of the upper end of that one compartment. Openings in the cap permit the egress of liquid from the cap upon tilting of the housing. The geometrical relationships are such that the compartment is opposite the egress opening so that, upon a dropping of the housing, the openings are in a position that prevents significant spillage.

7 Claims, 4 Drawing Figures

INFANT TRAINING TUMBLER

The present invention pertains to an infant training tumbler. More particularly, it relates to an infant training tumbler that affords advantageous results while yet requiring components necessitating only the simplest type of construction.

In the training of infants to drink liquids, it is, of course, necessary to proceed through a transition from the nipple-sucking stage to one of drinking from a cup-shaped container. The process of training at least often is fraught with difficulty. Drinking tumblers tend to be upset or dropped with resultant spillage of the contents. Even when tilted toward the lips of the child, spillage at the sides of the tumbler, on either side of the mouth, often results in undesired dripping if not outright overflow.

Of course, such incidents connected with the feeding of an infant are well known to anyone who has had that responsibility. As one result, the prior art includes a variety of approaches to the formation of training containers or tumblers designed to assist the infant new to drinking from a cup in doing a somewhat better job. Exemplary prior art is U.S. Pat No. 2,456,989—Polcyn, U.S. Pat. No. 2,765,639—Bryant, U.S. Pat. No. 3,085,710—McIlroy and U.S. Pat. No. 3,412,892—Waksman, et al. The carry-out food industry has also contributed to containers which feature protection against undue spillage. As an example, one may look at U.S. Pat. Nos. 3,866,043—Freemyer, 3,905,512—Albert, et al. and 3,341,062—Phillips. Included in the total picture revealed by such prior references is the concept of including a lip raised on one side to be engaged by the mouth and that of having only a limited availability of the liquid at any time so as to minimize spillage when the device is improperly used. Adjustability of the amount of liquid flow permitted from the container is known. No doubt, all of these features have proved to be advantageous. Nevertheless, the prior approaches have failed to address themselves to the problem of continued spillage upon a tipover or dropping of the container, and the means for adjusting flow from the container often has been rather complex in terms of structure.

It is, accordingly, a general object of the present invention to provide a new and improved infant training tumbler that overcomes deficiencies in such prior approaches.

Another object of the present invention is to provide a new and improved infant training tumbler which achieves such results while yet being exceedingly simple in terms of manufacture and economical in terms of cost.

In accordance with one feature of the present invention, an infant training tumbler includes an upright tubular housing, means within that housing for defining a liquid-containing compartment disposed primarily on one side of the longitudinal axis of the housing, a cap affixed on the upper end of the housing and extending across the top of that compartment, and means including at least one opening in the cap so as to permit egress of liquid out of the compartment and from the cap upon tilting of the housing. The opening is disposed on the side of the longitudinal axis opposite the side of the compartment.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals indicate like elements, and in which:

Figure 1:
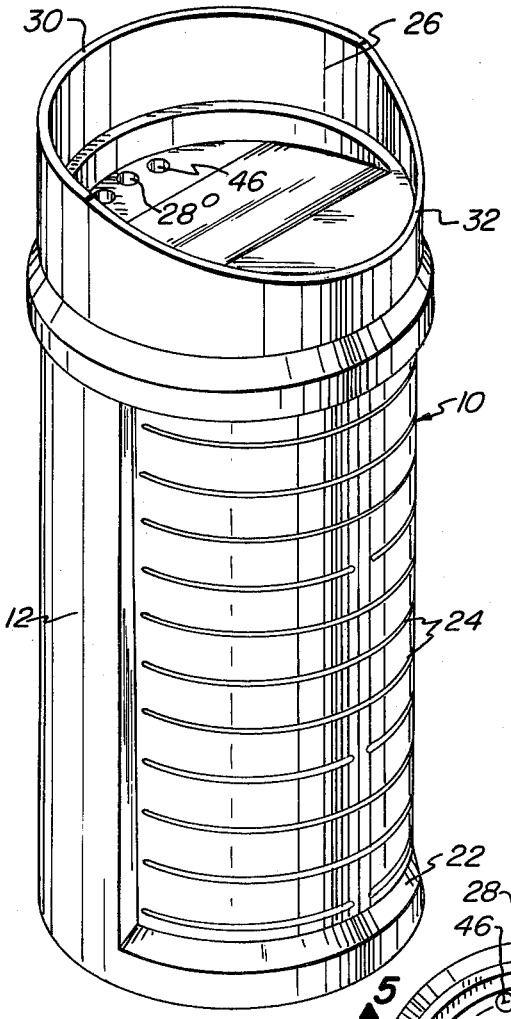
FIG. 1 is a perspective view of one embodiment of an infant training tumbler.
Figure 2:
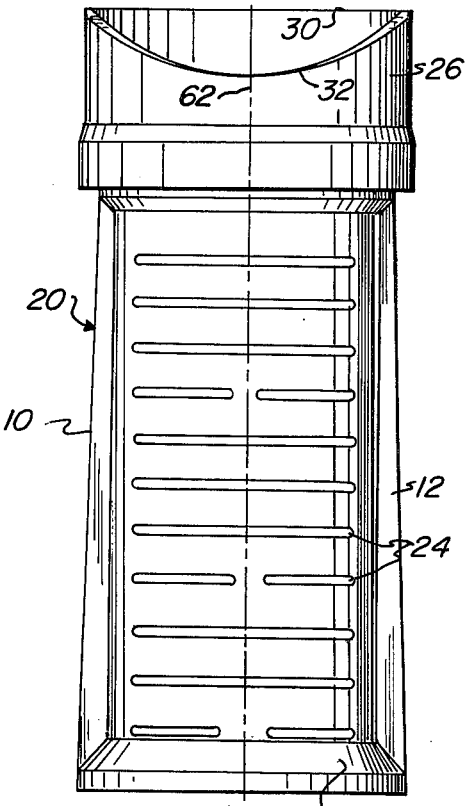
FIG. 2 is a front elevational view thereof.
Figure 3:
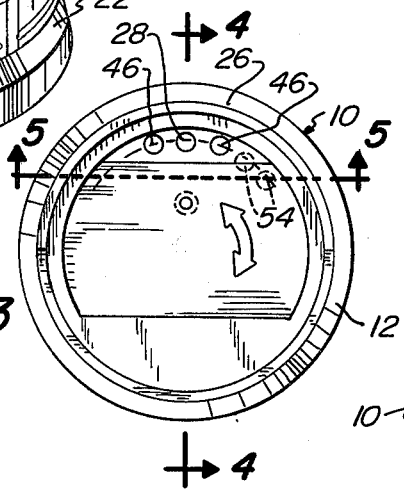
FIG. 3 is a top plan view thereof.
Figure 4:
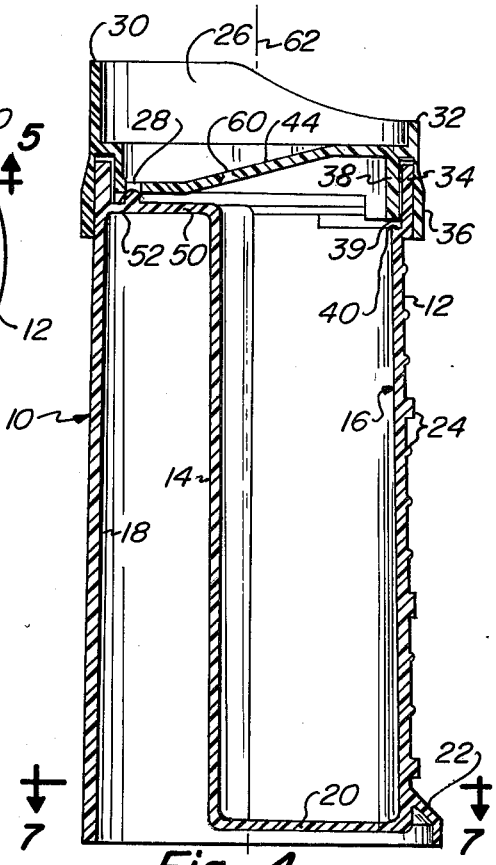
FIG. 4 is a cross-sectional view taken along the line 4—4 in FIG. 3.
Figure 5:
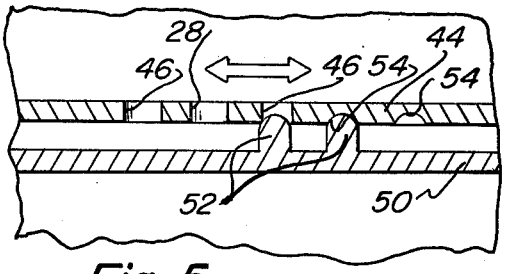
FIG. 5 is a fragmentary vertical cross-sectional view of a portion of the training tumbler as shown in the preceding figures.
Figure 6:
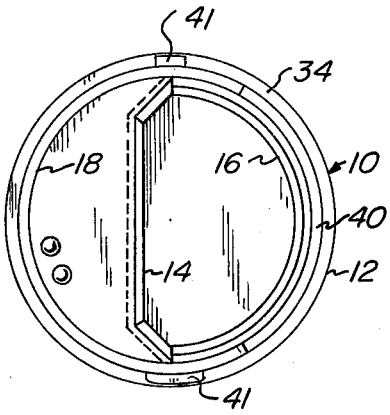
FIG. 6 is a top plan view thereof, with a cap removed from the top.
Figure 9:
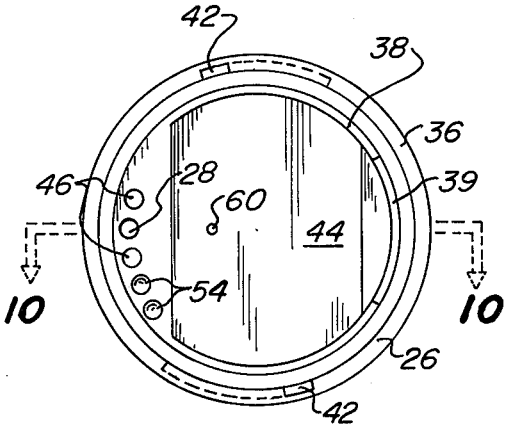
FIG. 9 is a bottom plan view of the cap.
Figure 7:
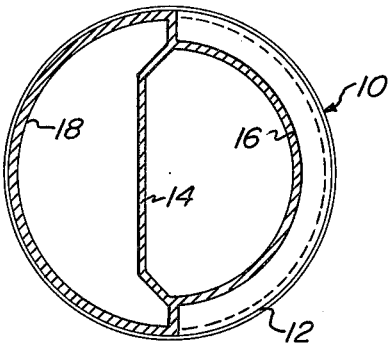
FIG. 7 is a cross-sectional view taken along the line 7—7 in FIG. 4.
Figure 8:
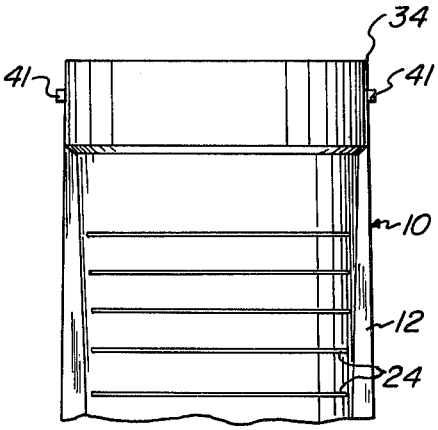
FIG. 8 is a fragmentary front-elevational view of a portion of the device as shown in FIGS. 1-4 but with that top cap removed.
Figure 10:
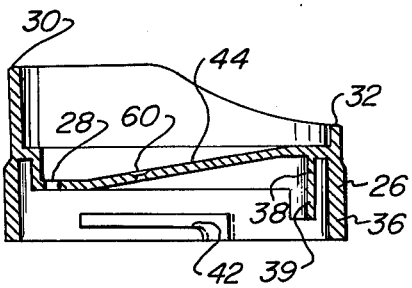
FIG. 10 is a cross-sectional view taken along the line 10—10 in FIG. 9.

An infant training glass or tumbler 10 includes an upright tubular housing 12. An upright internal web 14 divides housing 12 into a pair of longitudinal compartments 16 and 18. A lateral wall 20 closes the lower end of compartment 16. Preferably, the wall of housing 12 circumscribing the exterior of compartment 16 is recessed as at 22 and includes a succession of vertically-spaced ridges 24 that indicate the amount of liquid stored at any time within the compartment 16.

Affixed to the upper end of housing 12 is a cap 26 that is so formed as to permit a closure of the upper end of compartment 16. An opening 28 in cap 26 is disposed so as to permit egress of liquid from cap 26 as housing 12 is tilted to one side.

Cap 26 includes a front rim portion 30 raised substantially above the adjacent opening 28 and which merges into a lower rear rim portion 32 on the side of housing 12 opposite opening 28. This difference in elevation of rim portions 30 and 32 permits the infant to sip over portion 30 without having portion 32 hit his nose. Housing 12 is formed to include an upwardly projecting lip 34, while cap 26 has a downwardly projecting pair of radially-spaced collars 36 and 38 which are sandwichable over lip 34 so as to mount cap 26 in place atop housing 12. An ear 39 projects downwardly from a segment of collar 38 spaced opposite opening 28. Ear 39 seats within a recess 40 formed into the inner wall of lip 34, and the ear insures placement of cap 26 in proper orientation with respect to housing 12. For fastening, the side wall of housing 12 shortly beneath the top of lip 34 preferably includes a pair of diametrically-opposed pins 41 which latchingly engage with bayonet-type slots 42 formed in the lower skirt of collar 36 of the circumferential outer wall of cap 26.

Extending across the bottom portion of cap 26, and completing the actual closure of the upper end of compartment 16, is a transverse wall 44 in which opening 28 is formed. In addition to opening 28, moreover, there are a plurality of circumferentially-spaced similar openings 46; in this particular case, the total number of such openings is three. A facing transverse wall 50 joins the upper end of web 14 to the exterior side wall of housing 12. A pair of circumferentially spaced lugs 52 are disposed in wall 50 with each of lugs 52 being sized and positioned so as to close any selected one of openings 28 and 46 upon rotation of cap 26 and so that one or two of openings 28 and 46 may be closed to decrease the possible flow rate. At the same time, lugs 52 serve to cooperate with the openings to detent cap 26 in different rotative positions. Furthermore, a pair of additional recesses 54 are aligned circumferentially with openings 28 and 46 so as to enable additional detenting cooperation with lugs 52. It will thus be seen that the combination involving openings 28 and 46 enables egress of liquid from compartment 16 with selectability being provided as to the number of openings exposed at any given time. That is, the effective total size of egress opening is manually adjustable upon rotation of cap 26 relative to housing 12. Accordingly, upon tilting the housing 12, there is selectable control of the rate of flow of liquid stored in compartment 16. Also included generally centrally in transverse wall 44 is a vent hole 60.

It will be observed that compartment 16 is disposed primarily on one side of a plane containing the longitudinal axis 62 of housing 12. On the other hand, openings 28 and 46 are disposed on the opposite side of axis 62, across the container from the compartment. Thus, the center of gravity of liquid remaining within storage compartment or chamber 16 is on the side of housing 12 opposite that of the opening or openings through which liquid is dispensed to the infant. A result of this structural relationship is that, upon the tumbler being dropped or tipped over, the weight of liquid within compartment 16 tends to cause housing 12 to roll to a position in which openings 28 and 46 are uppermost. Consequently, the only spillage is of that small portion of liquid which already may have been drawn through openings 28 and 46 and remained atop transverse wall 44 or that small portion escaping from openings 28 and 46 on each revolution as the container rolls to a stop.

Raised lip 30 tends to attract the infant's mouth, so that the infant learns rather quickly to drink from the small cup defined at the near side of transverse wall 44. At the same time, the relief in rim portion 32 encourages that orientation, because it does not strike the infant's nose. As drinking capability progresses, the person supervising the infant usually will rotate cap 26 relative to housing 12 so as gradually to expose increasing ones of openings 28 and 46, thereby permitting a greater rate of flow. At the same time, the entire container still has the somewhat normal dimensions of a conventional drinking glass, and this serves to allow the infant or young child to become accustomed to handling that size of a container. As shown, the overall container is structured to sit normally on a table top or the like.

Notwithstanding the detailed features that are involved in the construction, it will be observed that the entire assembly is formed from only two molds. To minimize breakage, plastic is preferred as the material for both housing 12 and cap 26. The two principal components are readily taken apart for cleaning and filling.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

We claim:

1. An infant training tumbler comprising:

an upright tubular housing;

an upright internal web dividing said housing into a pair of longitudinal compartments;

a lateral wall closing the lower end of one of said compartments with one of said compartments being disposed primarily on one side of a plane containing the longitudinal axis of said housing;

a cap affixed on the upper end of said housing and completing a closure of the upper end of said one of said compartments;

and at least one opening in said cap permitting egress of liquid from said cap upon tilting of said housing, said opening being disposed on the opposite side of said plane containing said axis and being in liquid communication with said one of said compartments.

2. A training tumbler as defined in claim 1 in which a plurality of openings provide egress of said liquid, and which further includes means for selecting the number of said openings enabled.

3. A training tumbler as defined in claim 1 in which the effective size of said opening is manually adjustable.

4. An infant training tumbler comprising:

an upright tubular housing defining a compartment within which liquid may be stored;

a lateral wall closing the lower end of said compartment;

a cap completing a closure of the upper end of said housing, said cap including means for mounting the cap upon the upper margin of said housing while permitting rotation of the cap around the longitudinal axis of said housing;

a transverse wall located interiorly of said housing adjacent to and beneath said cap;

a plurality of circumferentially-spaced openings disposed in said cap;

a plurality of circumferentially-spaced lugs disposed in said transverse wall with each of said lugs being sized and positioned to close any selected one of said openings upon said rotation of said cap and to detent said cap in the selected rotative position;

and said lugs and said openings enabling selectable control of the rate of flow, upon tilting of said housing, of said liquid from said compartment through a selected number of said openings upon rotation of said cap around said axis and effecting detenting of said rotation upon such selection.

5. A training tumbler as defined in claim 4 in which said housing includes an upwardly projecting rim, in which said cap includes a downwardly-projecting pair of radially-spaced collars sandwichable over said rim, and in which one of said collars includes means for insuring mounting of said cap on said housing only in an orientation permitting such flow.

6. An infant training tumbler comprising:

an upright tubular housing;

means within said housing for defining a liquid-containing compartment disposed primarily on one side of a plane containing the longitudinal axis of said housing;

a cap affixed on the upper end of said housing and extending across the top of said compartment;

and means including at least one opening in said cap permitting egress of liquid out of said compartment and from said cap upon tilting of said housing, said opening being disposed on the side of said plane containing said longitudinal axis opposite said one side.

7. A training tumbler as defined in claim 6 in which said compartment is defined by an upright internal web which divides said housing into a pair of longitudinal enclosures one of which is said compartment, which further includes a lateral wall closing the bottom of said compartment, and which also includes another lateral wall extending beneath said cap and over the other of said enclosures so as to define fluid communication to said opening from said compartment.

* * * * *